US005875754A

United States Patent [19]

Ickinger

[11] Patent Number: 5,875,754

[45] Date of Patent: Mar. 2, 1999

[54] INTERNAL COMBUSTION ENGINE CYLINDER HEAD ARRANGEMENT

[75] Inventor: Frank Ickinger, Bietigheim-Bissingin, Germany

[73] Assignee: Dr. Ing. h.c.F. Porsche AG, Germany

[21] Appl. No.: 854,588

[22] Filed: May 12, 1997

[30] Foreign Application Priority Data

May 11, 1996 [DE] Germany ..... 196 19 183.1

[51] Int. Cl.[6] ..... F02F 1/00

[52] U.S. Cl. ..... 123/193.5

[58] Field of Search ..... 123/193.5, 193.3, 123/90.27, 90.33, 90.38

[56] References Cited

U.S. PATENT DOCUMENTS

| | | | |
|---|---|---|---|
| 4,823,747 | 4/1989 | Wagner et al. | 123/193.5 |
| 5,150,675 | 9/1992 | Murata | 123/193.5 |
| 5,458,100 | 10/1995 | Killer et al. | 123/193.5 |

FOREIGN PATENT DOCUMENTS

| | | |
|---|---|---|
| 0 353 988 A1 | 8/1989 | European Pat. Off. . |
| 41 16 942 CI | 5/1991 | Germany . |
| 43 07 368 A1 | 3/1993 | Germany . |
| 43 24 791 A1 | 7/1993 | Germany . |
| 44 21 057 C1 | 6/1994 | Germany . |
| 44 28 681 A1 | 4/1995 | Germany . |

*Primary Examiner*—Marguerta McMahon

*Attorney, Agent, or Firm*—Evenson, McKeown, Edwards & Lenahan, P.L.L.C.

[57] ABSTRACT

The cylinder head arrangement of an internal-combustion engine has a basic housing, a support component and a cylinder head cover. The three housing components are assembled such that two independent junction planes are formed. In both of these junction planes, grooves are placed in at least one of the two adjoining housing components and serve as oil ducts and form the mutually independent oil galleries or oil supply branches. These independent oil supply ducts supply different consuming devices with oil. Bores are largely eliminated and a course of the oil ducts which is free of intersections is provided also for very complex cylinder head arrangement having a large number of consuming devices.

11 Claims, 5 Drawing Sheets

INTERNAL COMBUSTION ENGINE CYLINDER HEAD ARRANGEMENT

BACKGROUND AND SUMMARY OF THE INVENTION

This application claims the priority of German application 196 19 183.1, the disclosure of which is expressly incorporated by reference herein.

The present invention relates to a cylinder head arrangement of an internal-combustion engine, and more particularly, to an engine cylinder head arrangement comprising a plurality of housing components including a basic housing placed on a cylinder block, a cylinder head cover and a support component configured to accommodate valve stroke transmitting elements, at least two common junction planes between two of the housing components, which rest against one another with respective flange surfaces thereof, and oil supply ducts.

DE 43 24 791 A1 describes a cylinder head arrangement which consists of a basic housing placed on the cylinder block, a support component inserted into the basic housing and a closingoff cylinder head cover. The support component is used for accommodating valve stroke transmitting elements constructed as bucket tappet elements. This support component is inserted into the basic housing. The cylinder head arrangement is closed off toward the top by a cylinder head cover which is placed in a common junction plane on flange surfaces of the exterior walls of the basic housing and onto a flange surface of the support component. In this common junction plane, the oil supply ducts are constructed as indentations within the flange surface and are combined to form an oil gallery and are used for supplying oil to the valve stroke transmitting elements.

Another cylinder head arrangement is described in DE 43 07 368 A1, within which five charge cycle valves respectively for each cylinder are guided in the basic housing. Three of these charge cycle valves are inlet valves and two are outlet valves. The valve stroke transmitting elements are guided or disposed on the support component, with the two outlet valves per cylinder being operated by bucket tappet elements. Two of the three inlet valves are also acted upon by bucket tappet elements which via a suitable control can influence the valve stroke of the assigned charge cycle valve. The third inlet valve is operated by an operating lever guided on the support component. In a cylinder head arrangement of this type, many bearing areas and sliding surfaces must be supplied with the lubricant (oil) because of the large number of moved constructional elements. Furthermore, if the switchable valve stroke transmitting elements are acted upon hydraulically and, as is usually the situation, are also supplied by way of the oil supply of the internal-combustion engine, multiple problems occur with respect to the overall oil supply to the cylinder head.

It is, therefore, an object of the present invention to improve the oil supply within a cylinder head arrangement such that the latter can be manufactured in a simple manner and at low cost, and permits an at least partially independent supplying of different consuming devices. In this arrangement, the bore expenditures within the cylinder head arrangement are minimized and, in particular, very long and cost-intensive and labor-intensive oil bores are avoided.

According to the invention, this object has been achieved by providing that in each of the at least two junction planes, grooves are formed in at least one of the assigned flange surfaces and constitute the oil supply ducts which form at least two oil galleries for supplying separate consuming devices.

Within two junction planes of the cylinder head arrangement, oil supply ducts are formed which are combined to form one oil gallery respectively. These oil supply ducts are shaped by grooves machined into the flange surfaces and form two oil galleries. From these oil galleries, a large number of consuming devices within the cylinder head arrangement can be supplied with oil.

In this arrangement according to the present invention, bores, whose manufacturing requires high expenditures and which are costly, are largely avoided. By dividing the oil supply within the cylinder head arrangement into at least two oil galleries, different consuming devices can be supplied. This becomes possible in particular as the result of the corresponding further feature of the individual oil supply ducts and a suitable connection with the oil supply of the cylinder block, differences are possible in the delivery volume and the pressure.

In an especially advantageous manner, a first oil gallery can be constructed in the junction plane between the basic housing and the support component and can be connected along a particularly short path with the oil supply within the cylinder block. If such a first oil gallery is supplied by way of known ascending pipes within the cylinder block, a very direct linking is possible which requires very few bores and thus also keeps the throttling losses low.

The second oil gallery can advantageously be formed in the junction plane bounded by the cylinder head cover so that a spatial separation is achieved with respect to the first oil gallery. Thus, the supply of a large number of consuming devices is provided in a simple manner which is free of intersections.

The supply of different consuming devices which make different demands with respect to the oil volume and/or the oil pressure is achieved in a particularly advantageous manner in accordance with the present invention in that within one oil gallery formed in the respective junction plane, two or more individual supply branches are formed. These supply branches can be arranged in a particularly simple manner to extend in each case in the longitudinal direction of the cylinder head arrangement and are constructed in different flange sections of the respective flange surface.

Other objects, advantages and novel features of the present invention will become apparent from the following detailed description of the invention when considered in conjunction with the accompanying drawings.

DETAILED DESCRIPTION OF THE DRAWINGS

Figure 3:
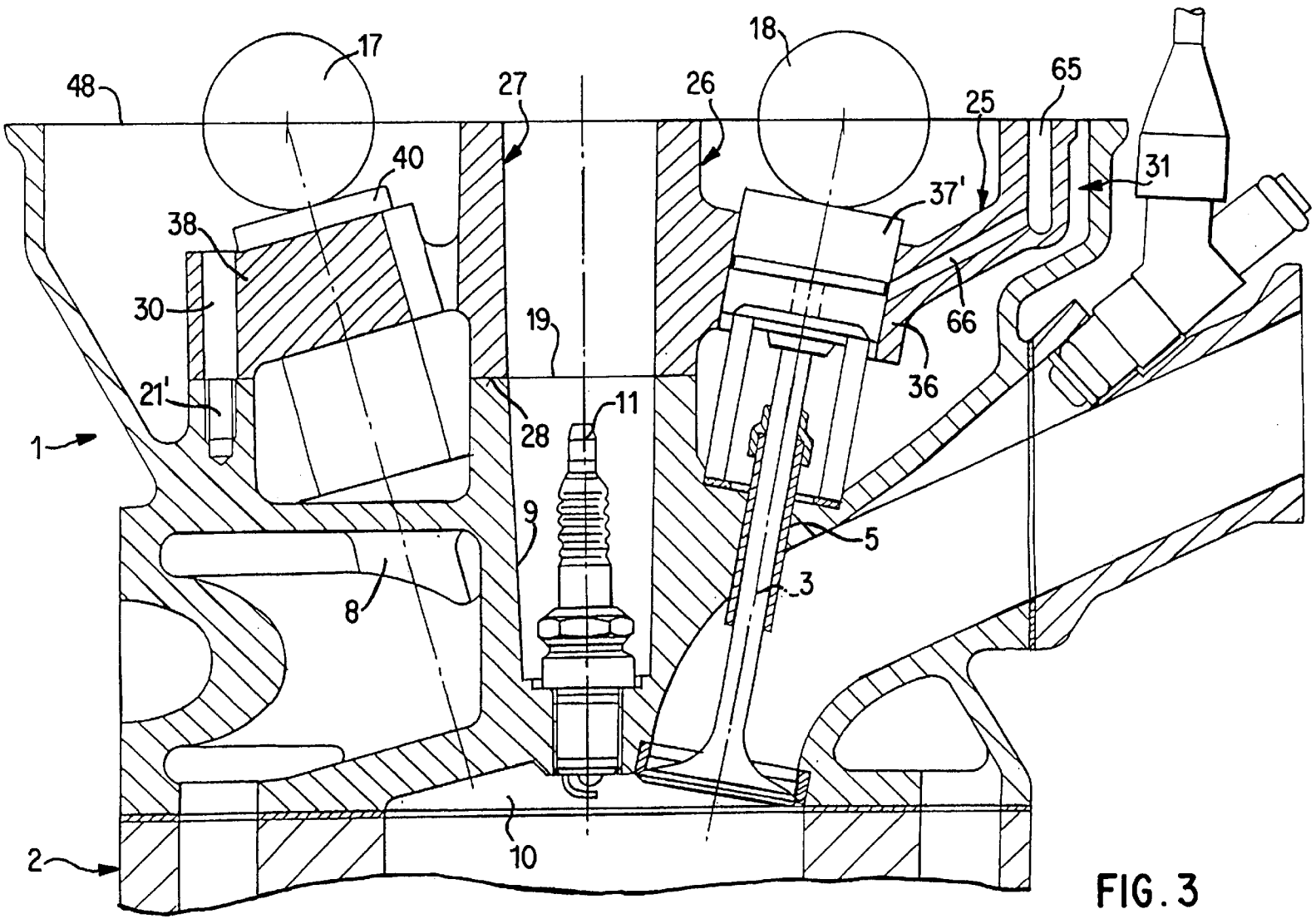
FIG. 3 is a partial cross-sectional view of the cylinder head arrangement along line III—III of FIG. 2.
Figure 4:
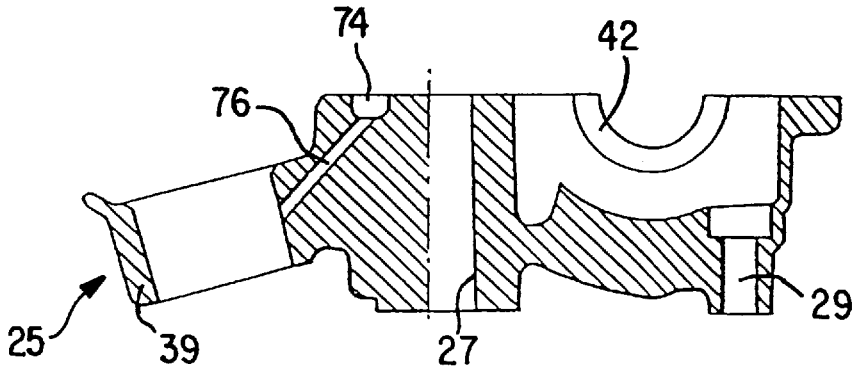
FIG. 4 is a cross-sectional view of the support component along line IV—IV of FIG. 2.
Figure 5:
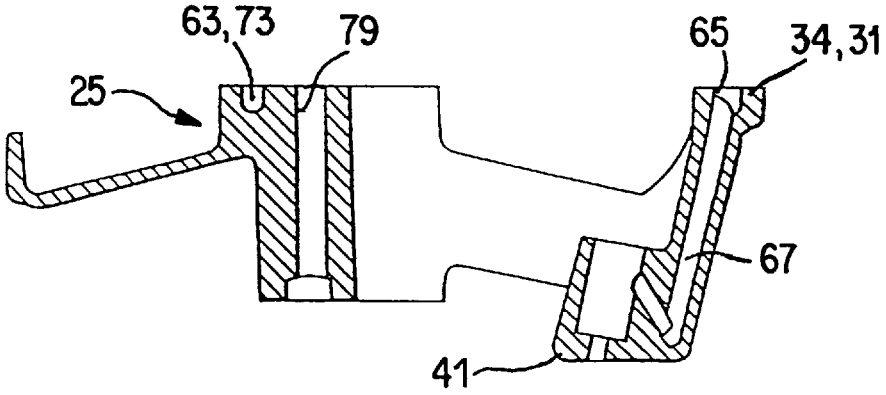
FIG. 5 is another cross-sectional view of the support component along line V—V of FIG. 2.

A multi-cylinder internal-combustion engine has a cylinder head arrangement with a basic housing 1 screwed to a cylinder block 2 (FIG. 3). The charge cycle of the internal-combustion engine takes place by way of five charge cycle valves 3 per cylinder, of which three are inlet valves and two are outlet valves. The valve guides 4 to 8 of the charge cycle valves 3 are arranged about a central shaft 9 which leads into the combustion chamber 10 and is used for accommodating a spark plug 11, an injection valve or a glow plug. The basic housing 1 has a trough-shaped interior which is open toward the top and is surrounded by three exterior walls 12, 13, 14 and the exterior walls 15 of a front-side timing case 16. This timing case 16 is used for accommodating driving devices (not shown in detail) for the two camshafts 17, 18 (FIG. 3) operating the charge cycle valves 3. The camshaft 17 is an outlet camshaft and operates the outlet valves guided in the valve guides 7, 8. The camshaft 18 operates the inlet valves guided in the valve guides 4, 5 and 6. A flat joint face or junction plane 19 is constructed in the interior of the basic housing. This junction plane 19 is formed by flange surfaces 20 to 22 which each border the shaft 9 leading into the respective combustion chamber 10. The flange-type front faces of bores 23, 24 are arranged in two rows and are situated in the junction plane 19, which bores 23, 24 are used for fastening a support component.

The support component 25 is constructed in one piece and has a center web 26 in which three openings 37 are formed which lengthen the respective shaft 9 as seen in FIG. 3. On the bottom side of the center web 26, flange surfaces 28 are constructed around the openings 27 and correspond to the flange surfaces 20 to 22 of the basic housing. The lower front faces of two rows of bores 29, 30 which are aligned with the bores 20', 21' and are used for fastening the support component 25 on the basic housing 1 are also situated in the junction plane 19.

The center web 26 of the support component 25 is surrounded by a U-shaped exterior web 31 which is composed of two opposite short web sides 32, 33 and a longitudinal web 34 connecting the web sides. Between the longitudinal web 34 and the center web 26, two tappet guides 35, 36 per cylinder are arranged as an extension of the valve guides 4, 5. These tappet guides 35, 36 are used for accommodating bucket tappet elements 57' such that the assigned inlet valves are operated by the camshaft 18.

On the opposite side of the center web 26, two additional tappet guides 38, 39 per cylinder are arranged as an extension of the valve guides 7, 8. These tappet guides are used for accommodating bucket tappet elements 40 such that the outlet valves of the camshaft 17 are operated. A lever guide 41, which is used for accommodating a known type hydraulic valve play compensating element, is also connected with the longitudinal web 34 per cylinder. A roller drag lever for operating the third inlet valve guided in the valve guide 6, is also supported on the longitudinal web.

In the illustrated embodiment, the bucket tappet elements assigned to the inlet valves are arranged to be switched. The hydraulic control permits a variation of the valve stroke transmission from the inlet camshaft to the respective assigned charge cycle valve. As a result of the known bucket tappet elements, for example, a stroke change or a disconnection of the stroke can then be achieved. The two inlet valves per cylinder operated by way of bucket tappet elements can be controlled independently of one another. The third inlet valve is operated by a lever element in a non-variable manner by the camshaft. The outlet valves are penetrated by bucket tappet elements which cannot be switched. Such a valve operation is described, for example, in the aforementioned DE 43 07 368 A1 .

The support component 25 is also used as a lower bearing support for bearing the camshafts 17, 18. For this purpose, the lower halves of bearing bores 42 are constructed on the top sides of the short web sides 32, 33. In addition, a transverse web 43 connected with the longitudinal web 34 is in each case situated between two cylinders. The respective lower portion of a bearing bore 44 is also constructed in the transverse webs 43. Two additional transverse webs 45 start out from the opposite side of the center web 26 and additional bearing bores 46 are formed therein.

The cylinder head arrangement is closed toward the top by a cylinder head cover 47. In a common junction plane 48 (FIG. 3), this cover 47 rests on the exterior walls 12 to 15 of the basic housing 1. Furthermore, this cylinder head cover 47 rests on the top sides of the center web 26, of the exterior web 31 (i.e., longitudinal web 34, short web sides 32, 33) and of the transverse webs 43, 45 constructed as a flange surface. The upper halves of the bearing bores 42, 44 and 46 are formed in the cylinder head cover 47. Screwed connections are provided for connecting the cylinder head cover with the exterior walls 12 to 15 of the basic housing 1. Furthermore, in the area of the bearing bores 42, 44 and 46 and in the area of the short web sides 32 and 33 as well as of the transverse webs 43 and 45, the cylinder head is connected by four rows of screwed connections 49 to 52 with the support component 25. The center rows of screwed connections 50 and 51 penetrate the support component 25 and reach into the basic housing 1.

Figure 6:
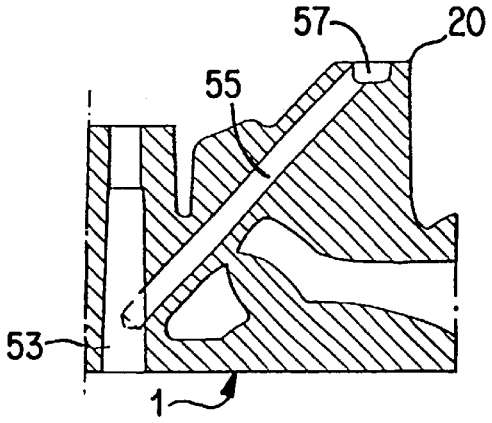
FIG. 6 is a cross-sectional view of the basic housing along the line VI—VI of FIG. 1.

The oil supply to the cylinder head arrangement takes place via two ascending pipes in the cylinder block 2. These ascending pipes are each arranged in the annulus of one of the screwed connections of the basic housing 1 with the cylinder block 2. One diagonal bore 55, 56 respectively starts out from the annuli marked 53 and 54. Diagonal bore 55 of these bores leads into an indentation 57 in the flange surface 20 as seen in FIG. 6. The second diagonal bore 56 leads into a pocket bore 58 whose front side is constructed as a flange surface 59. This flange surface 59 is also situated in the junction plane 19.

Figure 7:
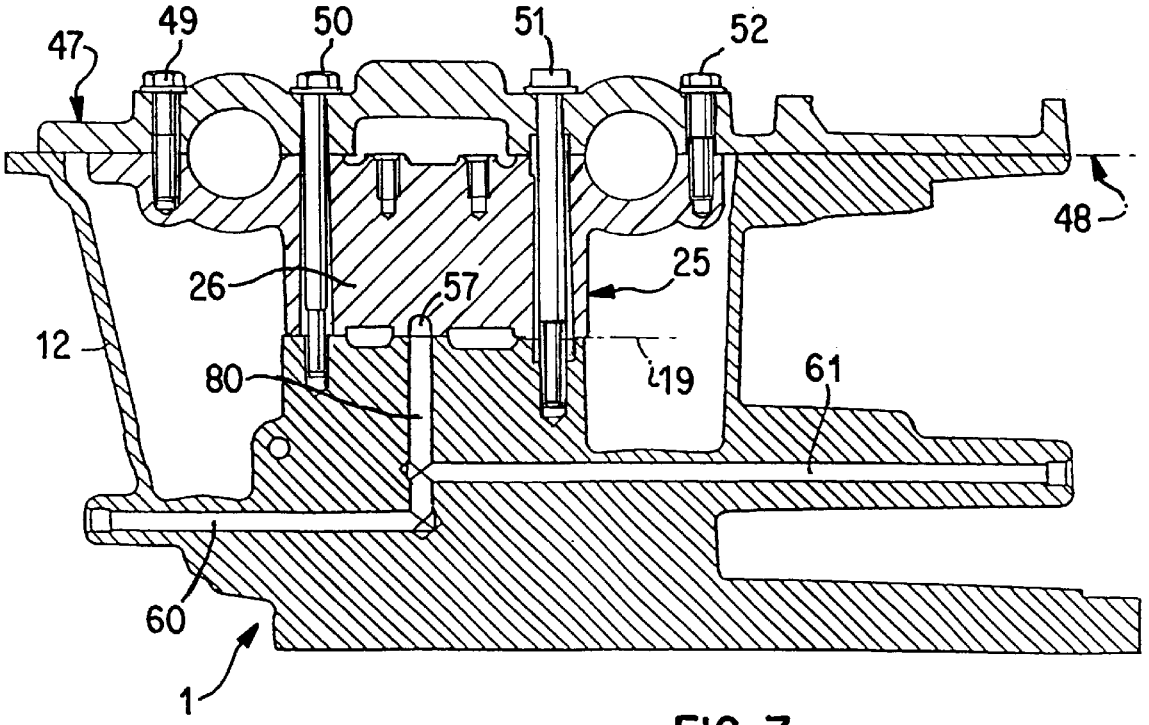
FIG. 7 is another cross-sectional view of the cylinder head arrangement along line VII—VII of FIG. 1.

The indentation 57 extends almost to the timing case 16 and changes into a bore 80. Two transverse ducts 60, 61 lead into this bore 80 as seen in FIG. 7. These transverse ducts 60 and 61 are used for supplying consuming devices within the timing case, such as chain tensioners and/or for supplying consuming devices arranged on the front side on the cylinder head arrangement, such as camshaft phase adjusters. The groove 57 within the junction plane 19 forms a first oil gallery 62. The supply for additional consuming devices, although not shown, is within the contemplation of the present invention without the exercise of additional inventive skills.

Figure 1:
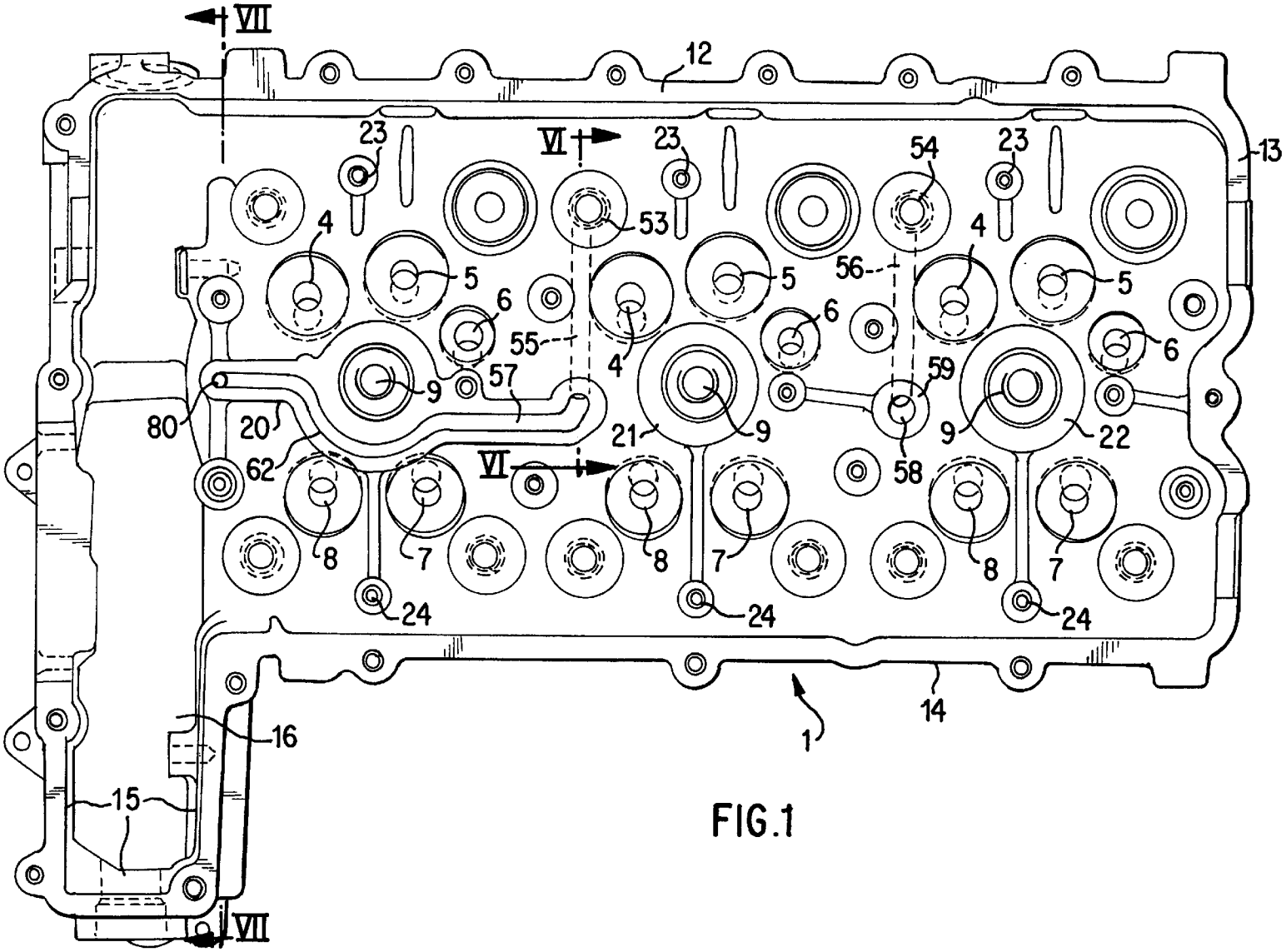
FIG. 1 is a top view of the open basic housing of the cylinder head arrangement in accordance with the present invention.

A second oil gallery 63 is formed in the junction plane 48 between the support component 25 and the cylinder head cover 47. A first supply branch 64 of the oil gallery 63 is formed essentially by a longitudinal groove 65 in the longitudinal web 34 as seen in FIG. 1. Diagonal bores 66, which lead into the tappet guides 36 and are used for supplying oil to the bucket tappet elements arranged therein, start out from this longitudinal groove 65. Additional diagonal bores 67, which start out from the longitudinal groove 65, lead into the lever guide 41 and supply the hydraulic valve play compensating element and the lever guide.

Figure 2:
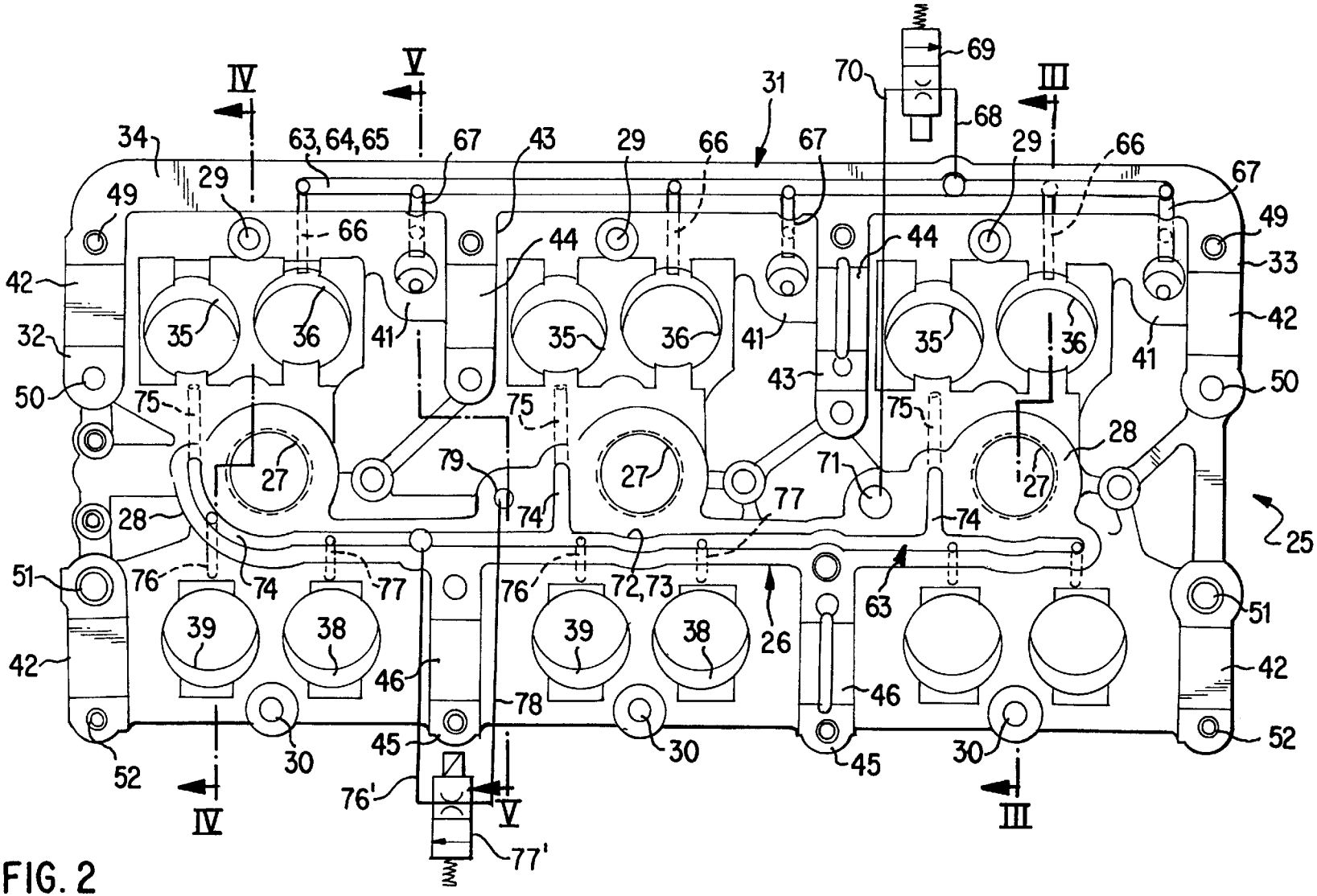
FIG. 2 is a top view of the flange surface of the support component facing away from the basic housing.

The supply branch 64 formed by the longitudinal groove 65 is connected by a duct 68 formed in the cylinder head cover 47, as schematically illustrated in FIG. 2, with a first control valve 69. An inlet duct 70 also formed in the cylinder head cover 47 connects the inlet side of the control valve 69 with a bore 71 which extends in the center web 26 starting from the junction plane 48 and leads into the pocket bore 58 in the basic housing 1.

A second supply branch 72 of the oil gallery 62 is formed by a longitudinal groove 73 which is formed in the center web 26 starting from the junction plane 48. Short connection grooves 74 also formed in the area of the junction plane start out from the longitudinal groove 73. These grooves 74 change into diagonal bores 75 which lead into the tappet guides 35 and supply the bucket tappet elements situated therein. Per cylinder, two additional diagonal bores 76, 77 start out from the longitudinal groove 73 and lead into the tappet guides 39, 38 and supply the bucket tappet elements of the outlet valves guided therein. By way of a duct 76' in the cylinder head cover 47 illustrated schematically in FIG. 2, the longitudinal groove 73 or the supply branch 72 is connected with the outlet of a second control valve 77'. An inflow duct 78 connects the inlet side of the second control valve 77' with a bore 79. Starting from the junction plane 48, the bore 79 extends in the center web 26 and, in the area of the diagonal bore 55, leads into the indentation 57 of the basic housing 1.

The two control valves 69, 77' are constructed such that, in their first switching condition, the oil flow is throttled in the supply branch 64, 72 connected behind them so that a given limit pressure is not exceeded. This limit pressure is sized such that the switching function of the switchable valve stroke transmitting elements (bucket tappet elements) just barely does not take place. This ensures, however, an oil supply which is sufficient for the purpose of lubrication. In the second switching position of the switching valves 69 and 77', the two supply branches are acted upon by the full delivery pressure of the oil supply of the internal-combustion engine or of the oil pump so that a switching-over of the hydraulically switchable bucket tappet elements takes place. The two switchable bucket tappet elements per cylinder can be switched independently of one another. The control valve/valves can be integrated into the cylinder head cover or into another structural element of the cylinder head arrangement without departing from the scope of the present invention.

In contrast to the illustrated embodiment with the switchable bucket tappet elements, other hydraulically operated elements for influencing the valve stroke can be provided, such as switchable rocker lever elements, drag levers or similar valve stroke transmitting elements. The number of switching elements per cylinder can be reduced or several switching elements switched jointly to connect them to one supply branch all within the spirit of the present invention. When a single switching element is constructed per cylinder, for example, one of the switching valves can be eliminated. Instead of the controllable pressure supply to switching elements for influencing the valve stroke, one of the supply branches can also be used for controlling camshaft phase adjusting elements.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Cylinder head arrangement of an internal-combustion engine, comprising a plurality of housing components including a basic housing placed on a cylinder block, a cylinder head cover and a support component configured to accommodate valve stroke transmitting elements, at least two common junction planes between two of said housing components, which rest against one another with respective flange surfaces thereof, and oil supply ducts, wherein in each of the at least two junction planes, grooves are formed in at least one of said flange surfaces and constitute in the plane of the flange surfaces the oil supply ducts which form at least two oil galleries for supplying separate consuming devices.

2. Cylinder head arrangement according to claim 1, wherein two independent oil supply branches are formed in at least one of the at least two junction planes within a common oil gallery of the at least two oil galleries.

3. Cylinder head arrangement according to claim 1, wherein in a second of the at least two junction planes, the support component and the cylinder head cover rest against one another.

4. Cylinder head arrangement according to claim 1, wherein at least one of the at least two oil galleries is arranged to supply switching elements for influencing stroke transmission to associated charge cycle valves.

5. Cylinder head arrangement according to claim 2, wherein at least one of the two oil supply branches in the common oil gallery is configured to provide hydraulic control for a group of switching elements to influence stroke transmission to associated charge cycle valves.

6. Cylinder head arrangement according to claim 2, wherein the two oil supply branches are configured to provide hydraulic control of two different groups of switching elements for influencing stroke transmission to associated charge cycle valves.

7. Cylinder head arrangement according to claim 1, wherein at least one of the at least two oil galleries is configured to supply to associated consuming devices an oil lubrication and a pressure control simultaneously.

8. Cylinder head arrangement according to claim 2, wherein a control valve is arranged to control oil pressure in at least one of the oil supply branches.

9. Cylinder head arrangement of an internal combustion engine comprising a plurality of housing components including a basic housing placed on a cylinder block, a cylinder head cover and a support component configured to accommodate valve stroke transmitting elements, at least two common junction planes between two of said housing components, which rest against one another with respective flange surfaces thereof, and oil supply ducts, wherein in each of the at least two junction planes, grooves are formed in at least one of said flange surfaces and constitute the oil supply ducts which form at least two oil galleries for supplying separate consuming devices, and wherein a first of the at least two oil galleries extends in a first junction plane formed between the basic housing and the support component.

10. Cylinder head arrangement of an internal combustion engine comprising a plurality of housing components including a basic housing placed on a cylinder block, a cylinder head cover and a support component configured to accommodate valve stroke transmitting elements, at least two common junction planes between two of said housing components, which rest against one another with respective flange surfaces thereof, and oil supply ducts, wherein in each of the at least two junction planes, grooves are formed in at least one of said flange surfaces and constitute the oil supply ducts which form at least two oil galleries for supplying separate consuming devices, and wherein a second of the at least two oil galleries extends in a second of the at least two junction planes which toward a top portion thereof is closed by the cylinder head cover.

11. Cylinder head arrangement of an internal combustion engine comprising a plurality of housing components including a basic housing placed on a cylinder block, a cylinder head cover and a support component configured to accommodate valve stroke transmitting elements, at least two common junction planes between two of said housing components, which rest against one another with respective flange surfaces thereof, and oil supply ducts, wherein in each of the at least two junction planes, grooves are formed in at least one of said flange surfaces and constitute the oil supply ducts which form at least two oil galleries for supplying separate consuming devices, and wherein at least one control valve is arranged to control oil pressure in at least one of the at least two oil galleries.

* * * * *